US009259763B2

(12) United States Patent
Bakula

(10) Patent No.: US 9,259,763 B2
(45) Date of Patent: Feb. 16, 2016

(54) METHOD AND APPARATUS FOR SCREENING

(71) Applicant: Derrick Corporation, Buffalo, NY (US)

(72) Inventor: John J. Bakula, Grand Island, NY (US)

(73) Assignee: Derrick Corporation, Buffalo, NY (US)

( * ) Notice: Subject to any disclaimer, the term of this patent is extended or adjusted under 35 U.S.C. 154(b) by 0 days.

(21) Appl. No.: 13/938,851

(22) Filed: Jul. 10, 2013

(65) Prior Publication Data

US 2015/0202658 A1 Jul. 23, 2015

Related U.S. Application Data

(60) Provisional application No. 61/669,989, filed on Jul. 10, 2012.

(51) Int. Cl.

| | |
|---|---|
| ***B07B 1/49*** | (2006.01) |
| ***B07B 1/46*** | (2006.01) |
| ***B07B 1/48*** | (2006.01) |
| ***B07B 1/28*** | (2006.01) |

(52) U.S. Cl.

CPC ..... *B07B 1/4672* (2013.01); *B07B 1/28* (2013.01); *B07B 1/46* (2013.01); *B07B 1/4609* (2013.01); *B07B 1/4618* (2013.01); *B07B 1/48* (2013.01)

(58) Field of Classification Search

CPC ..... B07B 1/28; B07B 1/4672; B07B 1/469
USPC ..... 209/401, 403
See application file for complete search history.

(56) References Cited

U.S. PATENT DOCUMENTS

| | | | | |
|---|---|---|---|---|
| 5,971,159 | A * | 10/1999 | Leone | B01D 29/012 209/330 |
| 7,578,394 | B2 * | 8/2009 | Wojciechowski | B07B 1/4645 209/274 |
| 2001/0032815 | A1 * | 10/2001 | Adams | B01D 29/012 210/388 |
| 2008/0251432 | A1 * | 10/2008 | Lilie | B07B 1/4618 209/682 |
| 2011/0120920 | A1 * | 5/2011 | Smith | B07B 1/06 209/397 |

* cited by examiner

*Primary Examiner* — Terrell Matthews
(74) *Attorney, Agent, or Firm* — Jason P. Mueller; Adams and Reese LLP

(57) ABSTRACT

A screen assembly for a vibratory screening machine is provided including a plate having perforations with edges that are neither perpendicular nor parallel to wires of a wire mesh of the screen assembly.

18 Claims, 9 Drawing Sheets

METHOD AND APPARATUS FOR SCREENING

CROSS-REFERENCE TO RELATED APPLICATIONS

This application claims benefit of U.S. Provisional Application 61/669,989 filed Jul. 10, 2012, which is incorporated herein by reference.

FIELD

The present disclosure relates generally to material screening. More particularly, the present disclosure relates to screen assembly plates, screening assemblies, methods for fabricating screening assemblies and parts thereof, and methods for screening materials.

BACKGROUND

Material screening includes the use of vibratory screening machines. Vibratory screening machines provide the capability to excite an installed screen such that materials placed upon the screen may be separated to a desired level. Oversized materials are separated from undersized materials. Over time, screens wear and require replacement. As such, screens are designed to be replaceable. See, e.g., U.S. Pat. Nos. 7,578,394 and 7,228,971.

Replacement screen assemblies are subjected to large vibratory forces and must be securely fastened to the vibratory screening machine. Replacement screens are often attached to a vibratory screening machine by tensioning members, compression members or clamping members.

The manufacture of screen assemblies typically includes: fabricating a screening material, often three layers of a woven wire mesh; fabricating an apertured backing plate; and bonding the screening material to the apertured backing plate. Critical to screening performance are: the size of the openings in the screening surface and apertured plate; structural stability and durability of the screening surface; and structural stability of the entire unit. Drawbacks to conventional assemblies include lack of structure stability and durability of the screening surface formed by the woven wire mesh layers and lack of open screening area. These drawbacks limit the application and performance of the screen assemblies.

Weave patterns in metal woven screens, or cloths, include warp and weft wires woven together so that the warp wires are at an approximate 90 degree angle to the weft wires. The spaces between the wires form relatively small screening openings. Existing perforated plates, or apertured plates, typically have relatively larger perforations (when compared to the small screen openings of the woven screens) over which the woven screen spans. The size of the screen openings and plate apertures directly affect the open screening area of the entire screen assembly and its performance. The woven screens are attached to the perforated plates such that the edges of the perforations in the plate are perpendicular and parallel to the wires in the woven screen, see, e.g., FIG. 4 of U.S. Pat. No. 7,578,394. When subjected to the loading conditions of a vibratory screening machine and screen surface use conditions encountered during separation of materials (e.g., the weight of the material being screened on the surface of the screen assembly) the woven screens often fail along the line where the edge of a perforation of the perforated plate is aligned with the weave of the woven screen. Failures are frequently due to the parallel and perpendicular alignment of the woven screen wires and edges of perforations. Also, the distance the wires of the woven screens span the perforations in the plate directly impacts failures. Generally, the larger the distance the wires have to span the larger the deflection of the wire screen over the aperture and the larger the shearing force applied at the edges of the aperture.

SUMMARY

According to an exemplary embodiment, a vibratory screening assembly for use on a vibratory screening machine is provided, including: a screen having woven wires forming a weave pattern; and a plate having: a front portion, a back portion, a first side and a second side; and perforations with edges. The front portion and back portion are substantially parallel. The first side and second side are substantially perpendicular to the front portion and the back portion. The plate is configured to have opposing tensioning forces applied to the first side and the second side. The screen is attached to the plate such that the wires forming the weave pattern are not parallel or perpendicular to the perforation edges. The perforation edges may be at approximately forty-five degree angles to the wires forming the weave pattern. The perforations may have a maximum span of approximately 1 inch in a direction of the wires forming the weave pattern. The perforations may be approximately 1.4142 inches long and approximately 0.7071 inches wide. The plate may be semi-rigid. The vibratory screen assembly may further include at least three layers of weave patterns. The plate may be substantially crowned in shape. The screen assembly may be configured to be installed with tension over a support structure. The support structure may be a crowned deck.

According to an exemplary embodiment, a vibratory screening assembly for use on a vibratory screening machine is provided, including: a screen having woven wires forming a weave pattern; and a plate having perforations with edges. The screen is attached to the plate such that the wires forming the weave pattern are not parallel or perpendicular to the perforation edges.

According to an exemplary embodiment, a perforated plate for use in a vibratory screening assembly is provided, including: a front portion, a back portion, a first side and a second side; and perforations with edges. The front portion and back portion are substantially parallel. The first side and second side are substantially perpendicular to the front portion and the back portion. The perforation edges are not parallel or perpendicular to the first side, the second side, the front portion, and the back portion. The perforation edges may be at approximately forty-five degree angles to the first side, the second side, the front portion, and the back portion. The perforations may be approximately 1.4142 inches long and approximately 0.7071 inches wide. The plate may be semi-rigid.

According to an exemplary embodiment, a method of screening materials is provided, including: attaching a screen assembly having a plate and screen to a vibratory screening machine; and screening the materials. The plate has perforations with edges. The screen has woven wires forming a weave pattern. The wires forming the weave pattern are not parallel or perpendicular to the perforation edges. The perforation edges may be at approximately forty-five degree angles to the wires forming the weave pattern. The perforations may have a maximum span of approximately 1 inch in a direction of the wires forming the weave pattern. The perforations may be approximately 1.4142 inches long and approximately 0.7071 inches wide.

DETAILED DESCRIPTION

The present disclosure provides for improved perforated plates for screen assemblies and improved screen assemblies and methods for fabricating the same. The plates may be metal or any other suitable material, e.g., a polymer or composite material. The plates may also include nanomaterials to improve strength and surface smoothness, particularly edge roughness.

According to an example embodiment of the present invention the perforations in the plate have a pattern that orients the edges of the perforations at an angle to the weave pattern in the screen cloth such that the woven wire is not aligned parallel or perpendicular with the perforated edge of the plate. In one embodiment the pattern orients the edges of the perforations at an approximate 45 degree angle to the weave pattern in the screen cloth.

Figure 1:
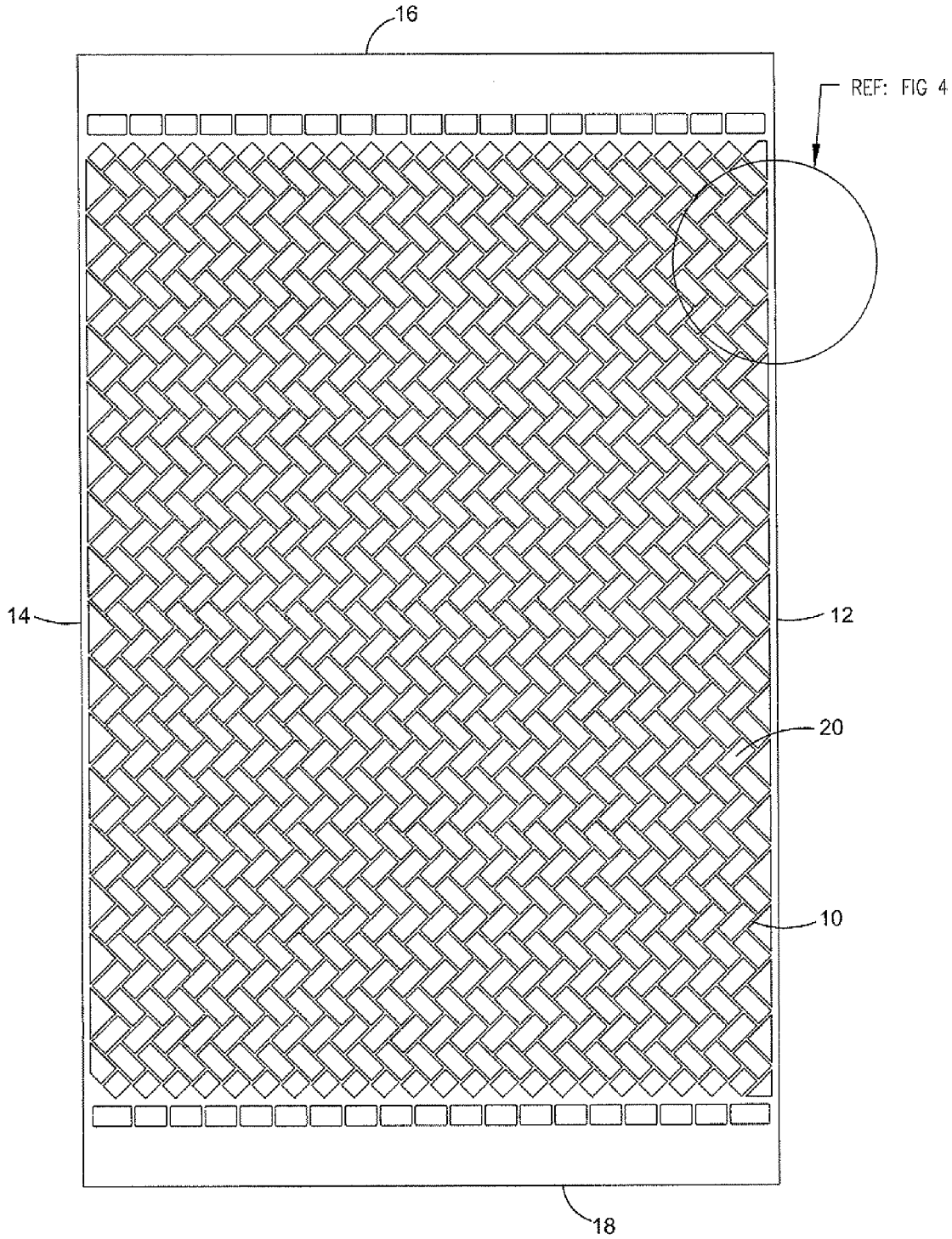
FIG. 1 is a top view of a support plate according to an exemplary embodiment of the present invention.

The attached Figures show example embodiments of the present invention. FIG. 1 shows a perforated metal plate according to an exemplary embodiment of the present invention. As shown, the plate has a front portion 12, a back portion 14, a first side 16 and a second side 18. Front portion 12 is substantially parallel to back portion 14. Front portion 12 and back portion 14 are substantially perpendicular to first side 16 and second side 18. The plate includes perforations 20, which have edges 22 (see, e.g. FIG. 4). Edges 22 are not perpendicular to front portion 12, back portion 14, first side 16 or second side 18. The plate is configured such that opposing tensioning forces may be applied to first side 16 and second side 18.

Figure 2:
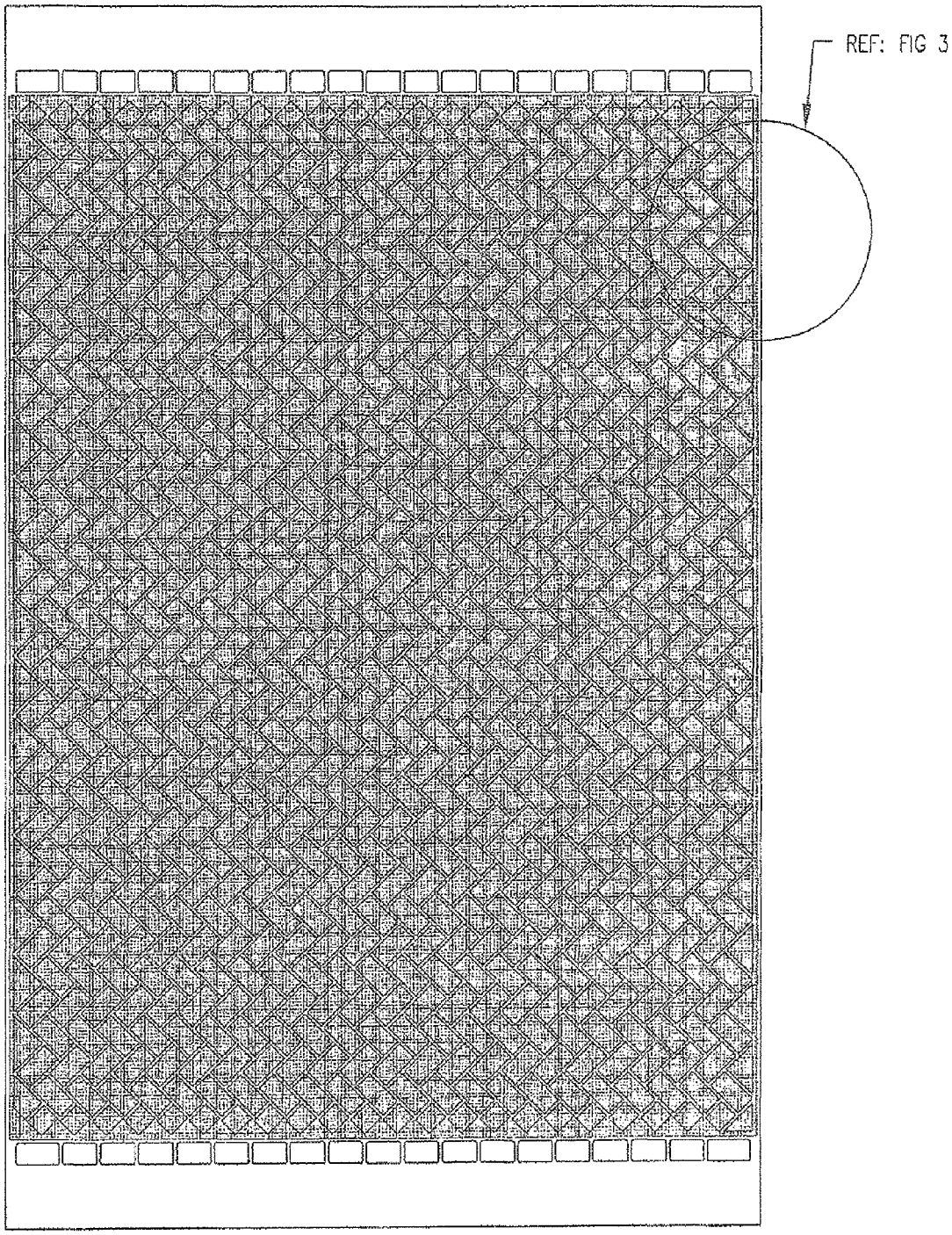
FIG. 2 is a top view of a screen assembly according to an exemplary embodiment of the present invention.
Figure 3:
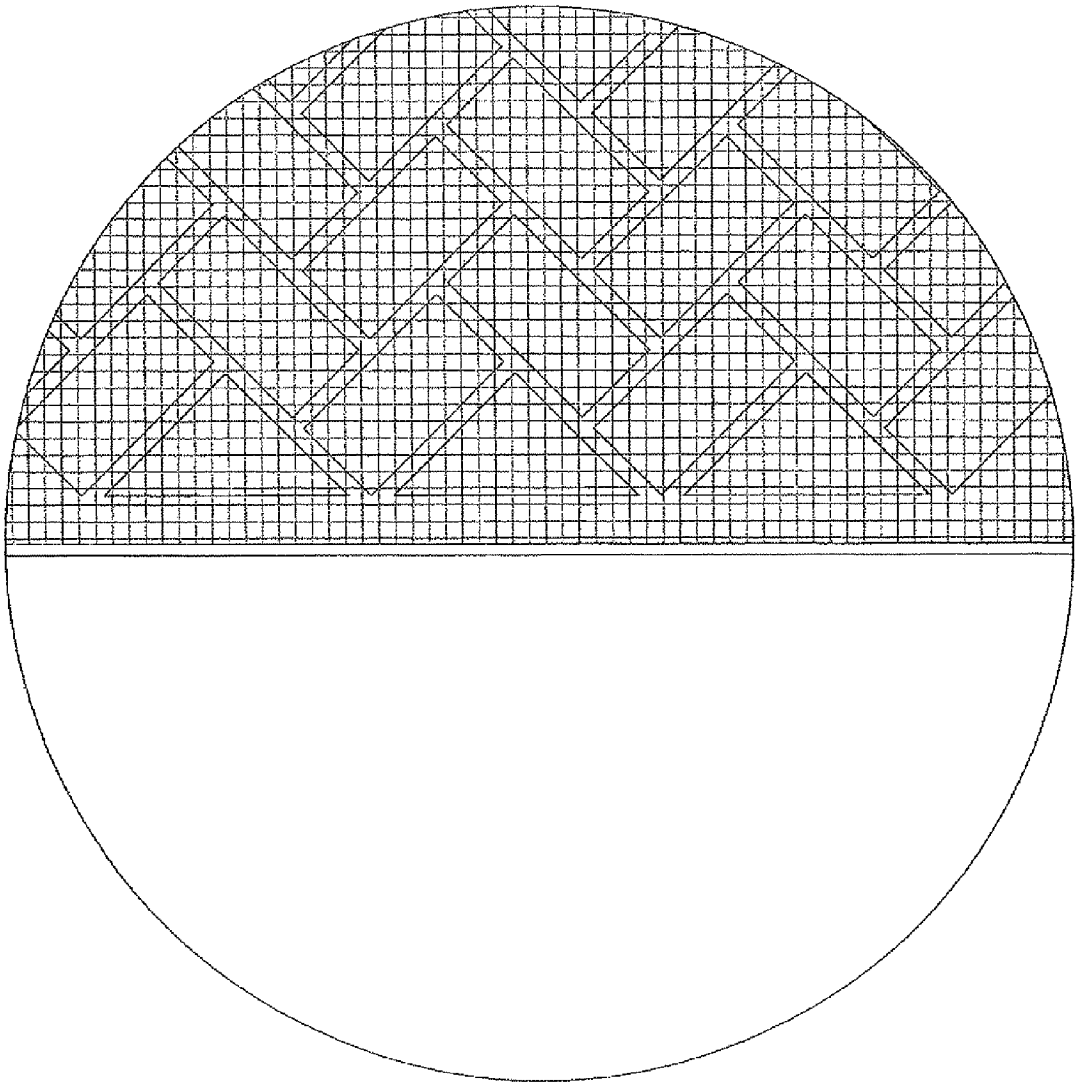
FIG. 3 is a blown up top view of a portion of the screen assembly shown in FIG. 2.
Figure 4:
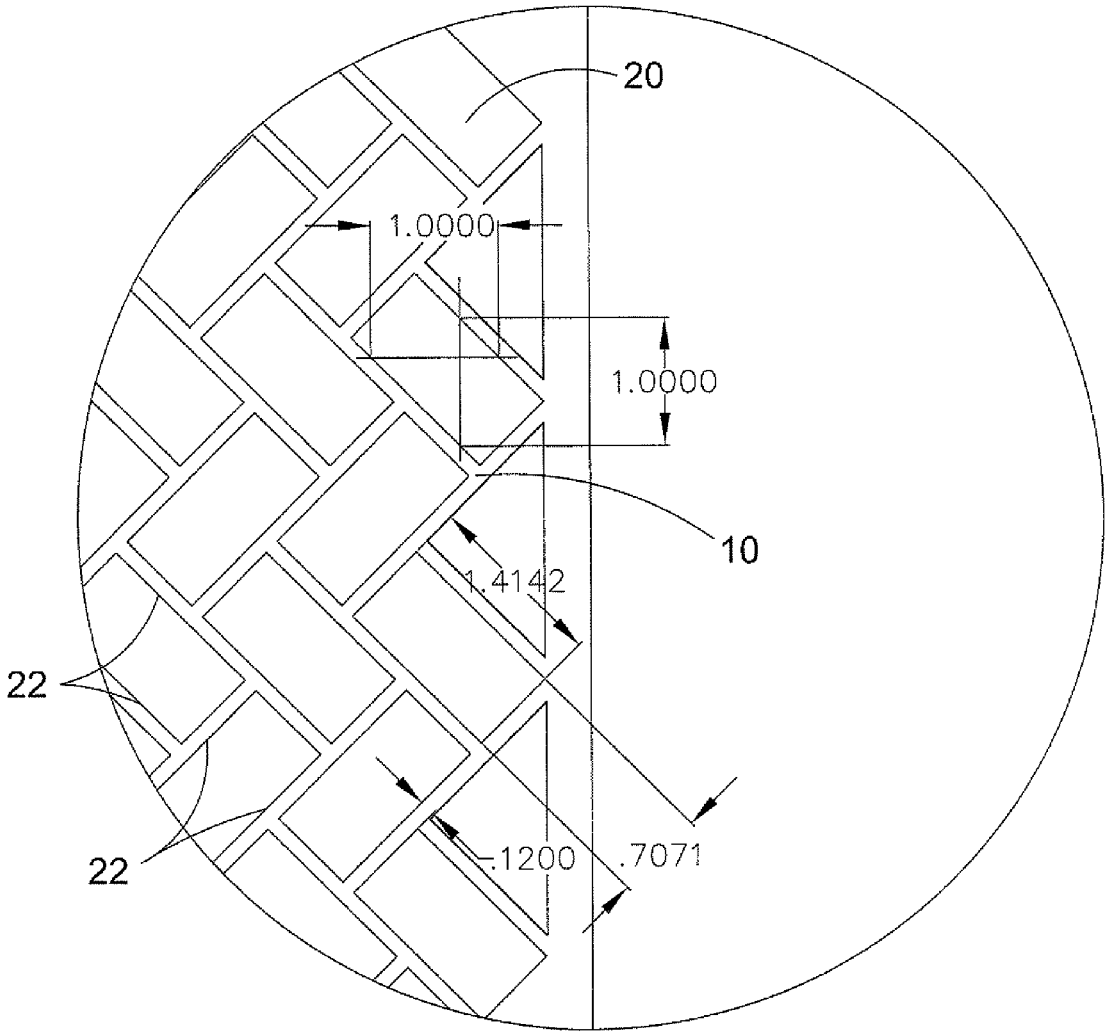
FIG. 4 is a blown up top view of a portion of the support plate shown in FIG. 1.

FIG. 2 shows the woven wire screen mesh positioned overlying the perforated metal plate. While the particular embodiment shown in FIG. 2 only shows one layer of screen mesh it is to be understood that the screen may have multiple layers of mesh that are attached together and the mesh may have various configurations, including undulating and/or flat portions. FIG. 3 shows a close-up view of a portion of a perforated metal plate with screen cloth wires over the perforations. FIG. 3 shows the pattern of the wire mesh screen which is neither parallel nor perpendicular to edges of apertures in the underlying support plate. FIG. 4. shows a close-up view of a portion of a perforated plate with specific dimensions according to exemplary embodiments of the present invention.

Figure 5:
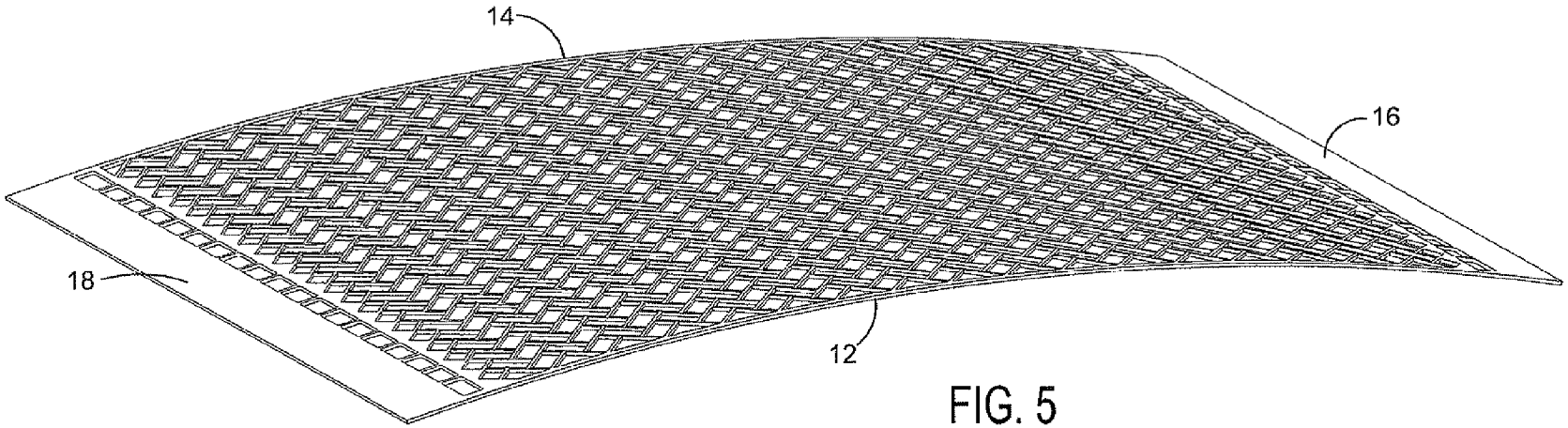
FIG. 5 is an isometric view of a support plate according to an exemplary embodiment of the present invention.
Figure 6:
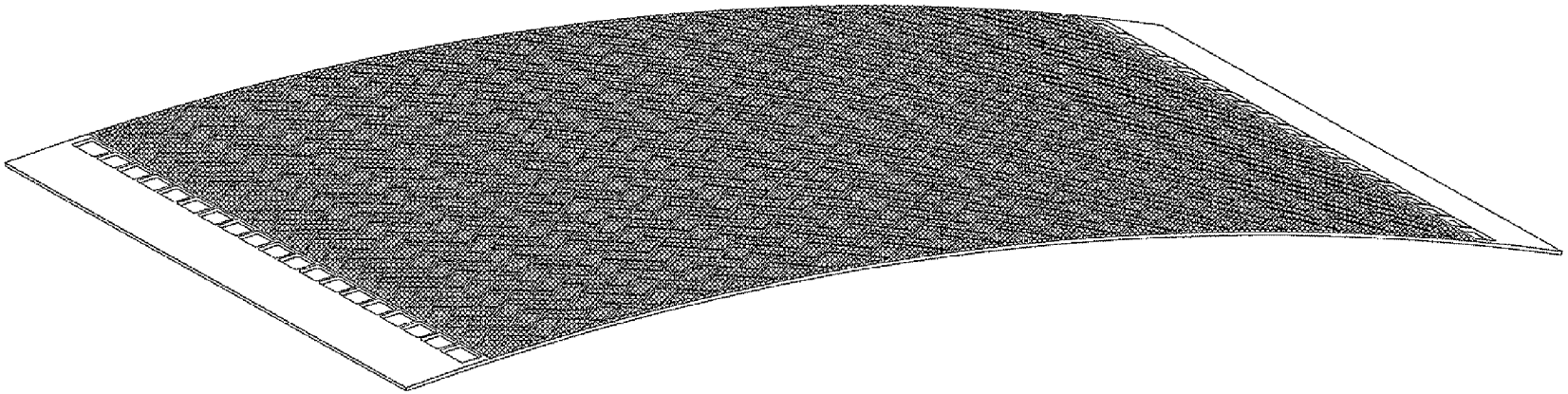
FIG. 6 is a isometric view of a support plate with wire mesh covering a top surface of the support plate according to an exemplary embodiment of the present invention.
Figure 7:
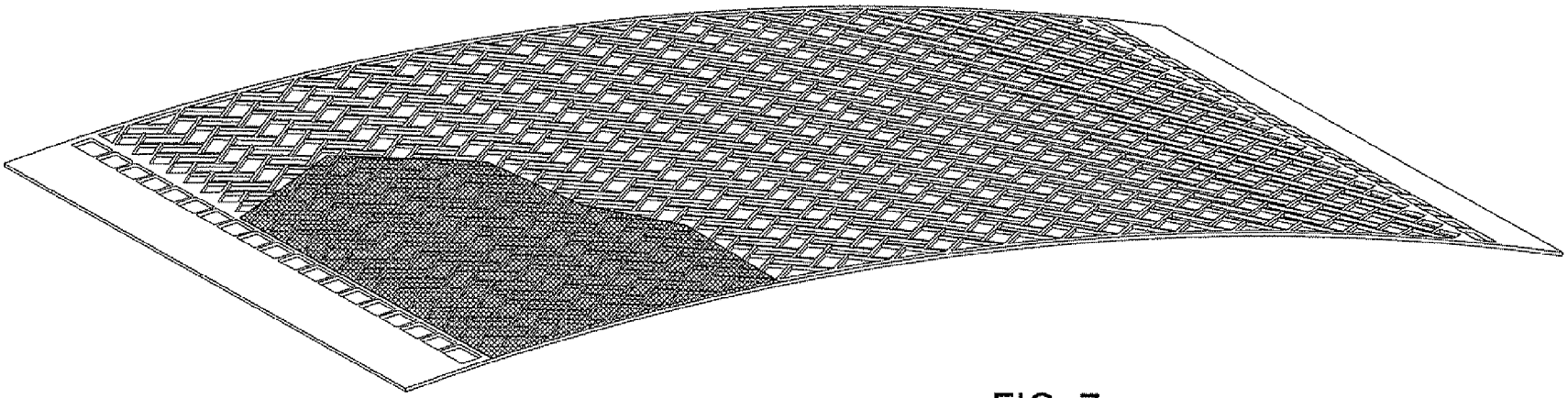
FIG. 7 is a isometric view of a support plate with wire mesh covering a portion of a top surface of the support plate according to an exemplary embodiment of the present invention.

FIGS. 5 to 7 are isometric views of a perforated plate according to an exemplary embodiment of the present invention. The perforated plate in both FIGS. 5 and 6 is slightly convex along a length of the perforated plate, which may be referred to as crowned in shape. FIG. 5 is a crowned plate only. FIG. 6 is a crowned screen assembly with a crowned plate having wire mesh secured thereto. FIG. 7 is a crowned plate having wire mesh covering only a portion of the plate. The embodiments shown may be installed on a vibratory screening machine via tensioning members. Embodiments may be installed with tension over a support structure such as a crowned deck, which deck may be a deck configured to match the curvature of a crowned screen assembly when installed on a machine. Embodiments may be convex or concave along a length, a width, or both. Embodiments may be substantially flat.

As shown in the Figures, the pattern of apertures in the plate prevents the woven wire screen from aligning directly parallel and/or perpendicularly with the perforated edges of the plate. In embodiments of the present invention, the unsupported distance of a woven wire cloth on a perforated plate may be less than or equal to 1 inch. Indeed, as shown in FIG. 4, the pattern of the perforations allows for the unsupported length of the woven wire cloth to be about 1 inch. The orientation of the wires of the cloth against the edges of the apertures in the plate, the size of the apertures in the plate and the distances of open area that the wires have to span provide for a more structurally stable and durable screening surface as well as increased open screening area of the entire screen assembly. Regarding opening screening area, generally, the less structural material that is used in the plate and the larger the apertures in the plate the more open screening area a screening assembly will have. The orientation and size of the plate apertures in the present invention provides for structural integrity while increasing opening screening area of the screen assembly. According to certain embodiments, while an individual wire's length over a perforation is about 1 inch, the actual perforation opening is about 1.4142 inches in length by about 0.7071 inches in width. See, e.g. FIG. 4. Thus, the orientation of the apertures allows for relatively large openings (important for maintaining the overall open screening area of the screen assembly) while having reduced distances over which the wires of the screen cloth must span (increasing the durability of the screen assembly). Indeed, according to example embodiments, the perforation pattern tends to allow for an increase in available open area on the plate over the conventional perforation pattern of about 6.6% while simultaneously improving durability of the screening surface.

In further example embodiments, when the improved screen assemblies are used with crowned screens (see, e.g., FIGS. 5 to 7), conveying characteristics are improved. Instead of the material being screened settling at the sides of the screening assembly, the material tends to move more uniformly across the screening assembly. The unique configuration of the plate aperture edges and wire weave provide for the improved conveying characteristics.

Figure 8:
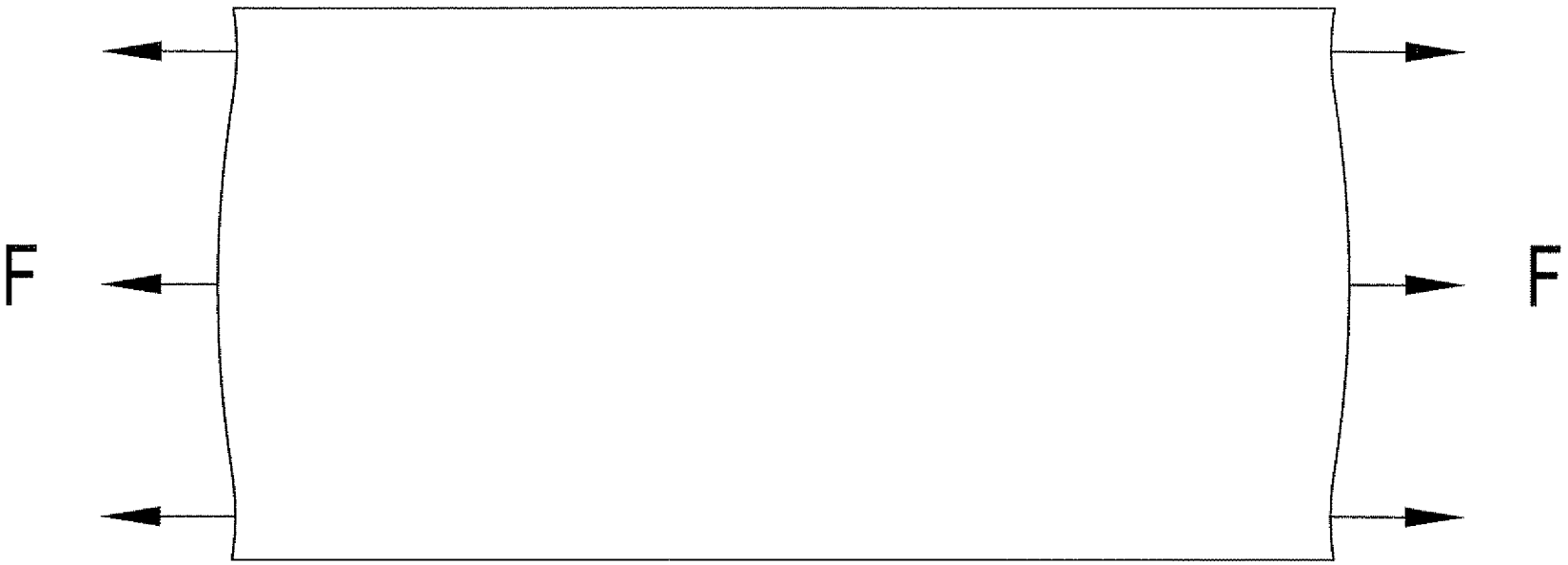
FIG. 8 is a representation of a support plate having tensioning forces applied at opposite ends of the support plate according to an exemplary embodiment of the present invention.
Figure 9:
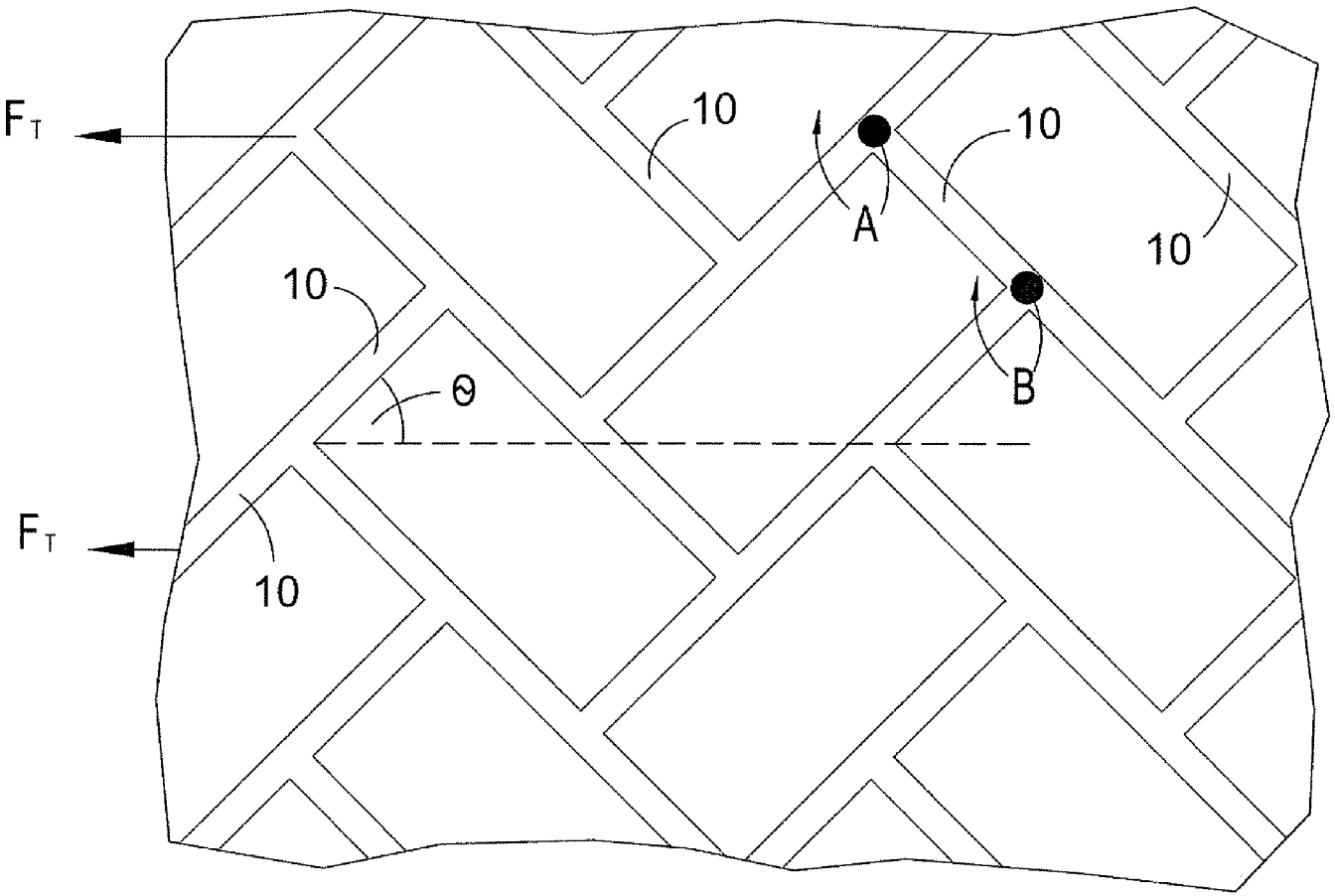
FIG. 9 is a blown up view of a portion of a support plate according to an exemplary embodiment of the present invention.

Embodiments of the present invention may provide increased resistance to tensile forces. FIG. 8 shows a perforated support plate having tensioning forces applied to the support plate. The tensioning forces F are applied in the directions shown by the arrows in FIG. 8. As shown, under sufficient tensioning forces, the support plate will tend to deform more substantially in a center than at the front portion or the back portion. FIG. 8 provides a blown up view of a portion of a support plate under tensioning forces $F_T$. The support plate shown in FIG. 8 has offset and angled perforations. Tensioning force $F_T$ is at angle $\Theta$ to support members 10 in this embodiment. As a result of $F_T$ being at angle $\Theta$ to the support members, the support members will tend to bend about points A and B as indicated in FIG. 9.

The force required for a support plate made of durable material, such as steel, to fail is substantially higher than the force required for the material to bend. An overall ratio of tensile strength to bending strength may be approximately 65 to 1. As a result, embodiments reduce rigidity away from sides of a support plate by a factor of more than 60. If a substantial uniform force is applied to opposing sides of an embodiment of the present disclosures, perforations of the plate may deform from being substantially rectangular to parallelograms. The deformation may be most pronounced near a center of a support plate.

The present invention provides extremely versatile and improved plates for screen assemblies, screening assemblies, methods for fabricating screening assemblies, and methods for screening materials. Embodiments of the present disclosure may be applied to various applications, including wet and dry applications and may be applied across various industries. According to further embodiments, a screen assembly can be fabricated in multiple different configurations, including having various screen opening sizes throughout the screen and having various screening surface configurations, e.g., various combinations of flat and undulating sections; and can be fabricated with application-specific materials and nanomaterials. Still further, each screen assembly may be customized to a specific application and can be simply and easily fabricated with various opening sizes and configurations depending on the specifications provided by an end user. The present invention is not limited to the oil and gas industry and the mining industry.

The embodiments of the present invention described herein, including screens, plates, and vibratory screening assemblies, may be configured for use with various different vibratory screening machines and parts thereof, including machines designed for wet and dry applications, machines having multi-tiered decks and/or multiple screening baskets, and machines having various screen attachment arrangements such as tensioning mechanisms (under and over mount), compression mechanisms, clamping mechanisms, magnetic mechanisms, etc. For example, the screen assemblies described in the present disclosure may be configured to be mounted on the vibratory screening machines described in U.S. Pat. Nos. 7,578,394; 5,332,101; 6,669,027; 6,431,366; and 6,820,748. Indeed, the screen assemblies described herein may include: side portions or binder bars including U-shaped members configured to receive over mount type tensioning members, e.g., as described in U.S. Pat. No. 5,332,101; side portions or binder bars including finger receiving apertures configured to receive under mount type tensioning, e.g., as described in U.S. Pat. No. 6,669,027; side members or binder bars for compression loading, e.g., as described in U.S. Pat. No. 7,578,394; or may be configured for attachment and loading on multi-tiered machines, e.g., such as the machines described in U.S. Pat. No. 6,431,366. The screen assemblies and/or screening elements may also be configured to include features described in U.S. Patent Publication No. 2009/0321328, including the guide assembly technologies described therein and preformed panel technologies described therein. Still further, the screen assemblies and screening elements may be configured to be incorporated into the pre-screening technologies (e.g., compatible with the mounting structures and screen configurations) described in U.S. Patent Publication No. 2008/0314804. U.S. Pat. Nos. 7,578,394; 5,332,101; 4,882,054; 6,669,027; 7,228,971; 6,431,366; and 6,820,748 and U.S. Patent Publication Nos. 2009/0321328 and 2008/0314804, which, along with their related patent families and applications, and the patents and patent applications referenced in these documents, are expressly incorporated herein by reference hereto.

While the embodiments of the present disclosure are described herein with reference to various implementations and exploitations, it will be understood that these embodiments are illustrative and that the scope of the inventions is not limited to them. It will be evident that various modifications and changes may be made to the example embodiments described herein without departing from the broader spirit and scope hereof. The specification and drawings are accordingly to be regarded in an illustrative rather than in a restrictive sense.

What is claimed is:

1. A vibratory screening assembly for use on a vibratory screening machine, comprising:

a screen having woven wires forming a weave pattern; and a plate having a front portion, a back portion, a first side and a second side; and perforations with edges forming a zigzag pattern;

wherein the front portion and back portion are substantially parallel;

wherein the first side and second side are substantially perpendicular to the front portion and the back portion;

wherein the plate is configured to have opposing tensioning forces applied to the first side and the second side; and wherein the screen is mounted on a top surface of the plate such that it spans the perforations, and the wires forming the weave pattern are not parallel or perpendicular to the perforation edges.

2. The vibratory screen assembly of claim 1, wherein the perforation edges are at approximately forty-five degree angles to the wires forming the weave pattern.

3. The vibratory screen assembly of claim 1, wherein the perforations have a maximum span of approximately 1 inch in a direction of the wires forming the weave pattern.

4. The vibratory screen assembly of claim 1, wherein the perforations are approximately 1.4142 inches long and approximately 0.7071 inches wide.

5. The vibratory screen assembly of claim 1, wherein the plate is semi-rigid.

6. The vibratory screen assembly of claim 1, further comprising: at least three layers of weave patterns.

7. The vibratory screen assembly of claim 1, wherein the plate is substantially crowned in shape.

8. The vibratory screen assembly of claim 1, wherein the screen assembly is configured to be installed with tension over a support structure.

9. The vibratory screen assembly of claim 8, wherein the support structure is a crowned deck.

10. A vibratory screening assembly for use on a vibratory screening machine, comprising:

a screen having woven wires forming a weave pattern; and a plate having perforations with edges;

wherein the screen is mounted on a top surface of the plate such that it spans the perforations, and the wires forming the weave pattern are not parallel or perpendicular to the perforation edges.

11. A perforated plate for use in a vibratory screening assembly, comprising:

a front portion, a back portion, a first side and a second side; and perforations with edges forming a houndstooth pattern;

wherein the front portion and back portion are substantially parallel;

wherein the first side and second side are substantially perpendicular to the front portion and the back portion;

wherein the perforation edges are not parallel or perpendicular to the first side, the second side, the front portion, and the back portion;

wherein the houndstooth pattern orients the edges of the perforations at an angle to the first side, the second side, the front portion, and the back portion.

12. The perforated plate of claim 11, wherein the perforation edges are at approximately forty-five degree angles to the first side, the second side, the front portion, and the back portion.

13. The perforated plate of claim 11, wherein the perforations are approximately 1.4142 inches long and approximately 0.7071 inches wide.

14. The perforated plate of claim 11, wherein the plate is semi-rigid.

15. A method of screening materials, comprising:

attaching a screen assembly having a plate and screen to a vibratory screening machine; and screening the materials;

wherein the plate has perforations with edges;

wherein the screen has woven wires forming a weave pattern;

wherein the screen is mounted on a top surface of the plate such that it spans the perforations, and the wires forming the weave pattern are not parallel or perpendicular to the perforation edges.

16. The method of claim 15, wherein the perforation edges are at approximately forty five degree angles to the wires forming the weave pattern.

17. The method of claim 15, wherein the perforations have a maximum span of approximately 1 inch in a direction of the wires forming the weave pattern.

18. The method of claim 15, wherein the perforations are approximately 1.4142 inches long and approximately 0.7071 inches wide.

* * * * *